US006150923A

United States Patent [19]

Johnson et al.

[11] Patent Number: 6,150,923

[45] Date of Patent: Nov. 21, 2000

[54] ALARM SYSTEM

[76] Inventors: William Nevil Heaton Johnson, Cliffe House, Village du Putron, St. Peter Port, Guernsey GY1 2TQ; Christopher George Rice, 22 Hocombe Drive, Chandlers Ford, Southampton SO53 5QE; Steven Hughes, Medina Croft, Winchester Road, Waltham Chase, Southampton SO32 2LG, all of United Kingdom

[21] Appl. No.: 09/051,551

[22] PCT Filed: Oct. 10, 1996

[86] PCT No.: PCT/GB96/02484

§ 371 Date: Oct. 26, 1998

§ 102(e) Date: Oct. 26, 1998

[87] PCT Pub. No.: WO97/13656

PCT Pub. Date: Apr. 17, 1997

[51] Int. Cl.[7] ..... G08B 3/10

[52] U.S. Cl. ..... 340/384.6; 340/384.1; 340/568.1; 340/571

[58] Field of Search ..... 340/425.5, 426, 340/430, 527, 528, 539, 568.1, 572.4, 571, 384.1, 384.7, 384.6, 384.71, 384.74; 307/10.1, 10.2; 342/357, 457; 310/322

[56] References Cited

U.S. PATENT DOCUMENTS

| | | | |
|---|---|---|---|
| 3,710,371 | 1/1973 | Whalen et al. | 340/571 |
| 4,006,371 | 2/1977 | Quirke | 310/322 |
| 4,155,082 | 5/1979 | Jones et al. | 340/656 |
| 4,264,901 | 4/1981 | Petersen et al. | 340/604 |
| 4,641,124 | 2/1987 | Davis | 340/426 |
| 4,679,026 | 7/1987 | Knakowski et al. | 340/426 |
| 4,794,368 | 12/1988 | Grossheim et al. | 340/426 |
| 5,223,844 | 6/1993 | Mansell et al. | 342/357 |
| 5,247,564 | 9/1993 | Zicker | 340/426 |
| 5,406,256 | 4/1995 | Ledel et al. | 340/539 |
| 5,448,221 | 9/1995 | Weller | 340/539 |
| 5,513,244 | 4/1996 | Joao et al. | 340/539 |
| 5,682,133 | 10/1997 | Johnson et al. | 340/426 |
| 5,844,482 | 12/1998 | Guthrie et al. | 340/568.1 |
| 5,874,902 | 2/1999 | Heinrich et al. | 340/825.54 |
| 5,923,256 | 7/1999 | Satake et al. | 340/575 |

FOREIGN PATENT DOCUMENTS

| | | |
|---|---|---|
| 8707406 | 9/1987 | Germany . |
| 3900823 | 7/1990 | Germany . |
| 683413 | 6/1994 | Germany . |
| 2276023 | 9/1994 | United Kingdom . |
| 2279478 | 1/1995 | United Kingdom . |
| 2280527 | 2/1995 | United Kingdom . |

*Primary Examiner*—Daniel J. Wu
*Assistant Examiner*—Van T. Trieu
*Attorney, Agent, or Firm*—Clifford A. Poff

[57] ABSTRACT

An alarm system for detecting attempted theft of an article includes means incorporated in the article itself and arranged to transmit and to continuing transmitting an alarm signal when the article is removed from its original location. An example of the alarm system provides an audible alarm, or transmitted alarm, and is arranged to be operated when a thief removes or attempts to remove a car radio, cassette player, compact disc player or the like from a car. Unauthorized removal of the unit from a car is detected by the consequent breaking of an electrical circuit which may be the power supply connections to the radio from the car electrical system or may be the connections to the loudspeakers or the radio aerial.

6 Claims, 1 Drawing Sheet

ALARM SYSTEM

CROSS REFERENCE TO RELATED APPLICATIONS

None

BACKGROUND OF THE INVENTION

1. Field of the Invention

This invention relates to alarm system for detecting theft or attempted theft of an article and producing an alarm signal upon such detection.

2. Description of Related Art

A particular, but not exclusive, object of the invention is to provide an alarm system adapted to prevent or discourage theft of fitted radios, cassette players, CD players, radio/cassette players, radio/CD players and the like, from motor cars or other vehicles, such items all being referred to herein, for convenience, as car radios.

According to one aspect of the invention there is provided an alarm system for detecting attempted theft of an article, the system including or comprising means incorporated in the article itself and arranged to transmit and to continue transmitting an alarm signal when the article is removed from its original location.

According to another aspect of the invention there is provided an alarm system for detecting attempted theft of an article or appliance connected with a power supply, the system being arranged to detect disconnection of the article or appliance from such supply.

BRIEF SUMMARY OF THE INVENTION

In a preferred embodiment of the invention, an alarm system for providing an audible alarm, or transmitted alarm, is provided, arranged to be operated when a thief removes or attempts to remove a car radio, cassette player, compact disc player or the like from a car. Unauthorised removal of a car radio or the like from the standard slot provided in the console at the front of the car is preferably detected by the consequent breaking of an electrical circuit which may preferably be the necessary power supply connections to the radio from the car electrical system or may for example be the connections to the loudspeakers or the radio aerial. Alternatively, an auxiliary connection dedicated to the alarm system may be provided.

Preferably the alarm system is incorporated in the radio itself, being powered, for example, by a rechargeable battery within the radio casing and which is kept charged by the vehicle electrical system in normal use. The alarm preferably incorporates an appropriate sound-producing device, for example an efficient piezo-electric transducer, or a horn powered by a small compressed gas container within the radio casing and controlled by a electrically operable valve controlled in turn by the alarm system. The alarm system may also, or alternatively, be arranged to spray or exude a marker substance onto the thief, or may also, or alternatively be arranged to send a radio signal allowing the stolen radio to be "tracked" by a suitable receiver with which the owner, or the police, for example may be provided.

The radio preferably incorporates means for disabling the alarm to allow the legitimate owner to remove the radio when necessary, such means being, for example, key operated or including means whereby a predetermined code known only to the owner may be entered. As in known coded car radios, the means for entering the code may be afforded by operating buttons, etc. already provided on the radio for programme selection etc. Alternatively the radio may incorporate a receiver, for example, an infra-red or ultrasonic receiver, whereby a predetermined key or code signal can be transmitted from a remote control device to disable the alarm. Conveniently, where the car is provided with a remotely controlled e.g. infra-red controlled door-locking or car alarm system, the alarm system may be capable of being disabled by operation of the same infra-red transmitter used to operate the remotely controlled door locking or car alarm system. Preferably the alarm system is incorporated in the radio as an integral part thereof, for example contained within the casing of the car radio. However, if desired, the alarm system may be provided as an "add on" unit, for example to be interposed in the power supply connections between the radio and the car battery and arranged to operate whether the radio is disconnected from the "add on" unit or the "add on" unit plus radio disconnected from the battery.

The system may be arranged so that the alarm is not activated merely by blowing of a fuse or removal of the car battery.

However, the system may be arranged to be sensitive to momentary disconnection of the car radio from the car power supply and/or to a change in the voltage of the power supply connected to the car radio, so that even if a thief, aware of the presence or possible presence of the alarm system should, after removal of the radio, quickly place a battery of the same voltage as the car battery (usually 12 volts) across the power supply leads, or should place such a battery across the power supply leads of the radio before disconnecting the latter from the car power supply, this will not prevent actuation of the alarm. In such an arrangement, sensors associated with the alarm system may be arranged to detect, specifically, blowing of the respective fuse or removal of the vehicle battery from the vehicle and logic circuitry forming part of the alarm system is arranged to prevent the alarm being set off in these circumstances. The vehicle may incorporate voltage regulation means preceding the radio connectors arranged to provide an accurately regulated non-standard voltage to the radio, for example 11.5 volts, and the alarm system may be arranged to detect a change of the supply voltage from 11.5 volts to 12 volts if a thief should attempt to substitute a 12 volt battery carried by the thief for the normal power supply to the radio.

The invention is also applicable to protection of other property apart from car radios. Thus, for example, expensive or valuable domestic electrical items, or electrical office items such as computers, video recorders, televisions or the like may have such an alarm incorporated therein and adapted to be activated upon disconnection of the respective device from the mains supply. By way of example such an alarm incorporated in a computer may be arranged to be operated if the computer casing is disturbed or is opened, for example by a thief intent upon stealing components. Preferably the alarm system, in such a case, is arranged not to be activated by, for example, switching to "off" an on/off switch on a wall socket or by the blowing of a fuse. For example, the device may be arranged to detect disconnection of the respective apparatus or property from the earth or neutral supply line.

Valuable items not normally electrically connected, may also be protected by the invention. For example, valuable paintings may have an appropriate alarm device incorporated in the frame or secured to the back of the painting and connected to an immovable power supply, for example the mains supply. Thus a combined alarm and lighting unit for a picture may be plugged into a convenient mains socket and may incorporate an alarm system in accordance with the invention. In these domestic and office applications, of course, the alarm system is also adapted to be disabled, when necessary, by the legitimate owner (as may be necessary, for example if the respective equipment is to be moved or taken away for repair). Again, depending upon the nature of the item, the alarm disabling means may be operable by a physical key, or by manual entry of a secret code, or by a swipe card or by transmitting a disabling infra-red or ultrasonic signal from a separate remote control unit.

In domestic applications, the alarm system may be arranged, when the protected item is disturbed, but before it is disconnected from the mains, to transmit an alarm signal on the mains wiring in the house or other building, in manner known per se, to a receiver/decoder in some other part of the house or building, where, for example, an audible or visual alarm may be provided without alerting the thief. Alternatively, the alarm system may be arranged to transmit signals continuously along the domestic wiring in normal conditions, and a receiver facility is some other part of the building may be arranged to generate an alarm signal upon cessation of transmission of signals from the item on the domestic wiring, consequent upon the disconnection of the protected item from the domestic wiring.

The alarm may alternatively or additionally be triggered by a movement-sensitive device incorporated in the item being protected, for example a pressure sensitive diaphragm or active or passive infra-red device and may be adapted to be thus activated by movement of an intruder in the room containing the protected item or by movement of the item itself or by opening or closing of a door into the room in which the item is housed. The alarm system may incorporate a delay feature, that is to say, the alarm may sound (or, if not acoustic, be transmitted) only after a predetermined delay after the event which triggered its operation so that, for example, the alarm may start producing its alarm signal when the thief, with the stolen item, is in a public thoroughfare.

In another variant of the invention, the alarm may be arranged to be triggered, alternatively, or additionally, by an electronic tag secured to or incorporated in the article protected passing complementary detector means associated with the doorways of a building or room or of a vehicle in which the article is normally kept. In this case, the detector circuitry associated with such doorways may itself be arranged to produced an alarm signal and/or, to transmit an activating signal to alarm means in the protected item to cause that alarm means to produce its alarm signal, either immediately or after a predetermined delay. Conversely, of course, the doorways may, in effect, be electronically "tagged" and the alarm means incorporated in the protected item may be arranged to detect passage of a doorway to activate the alarm. Likewise, particularly valuable components in a protected product, for example, integrated circuit "chips" in a computer, may have electronic "tags" associated therewith so that the alarm system can detect removal of these from the building in which the computer was located.

Figure 1:
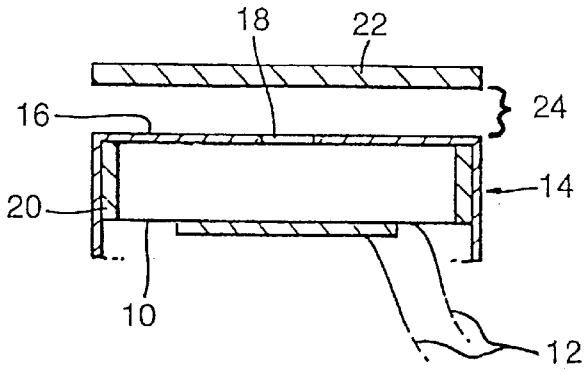
FIG. 1 is a sectional view illustrating a preferred form of sounder or buzzer for the system of the present invention.

Where, in any of the arrangements described above, an audible alarm is provided, this may conveniently take the form of a piezo-electric sounder or "buzzer" as illustrated in the accompanying drawing. Referring to the accompanying drawing, which shows the preferred form of such sounder or buzzer in section, the sounder is a diaphragm which shows the preferred form of such a sounder or buzzer in section, the sounder comprises a diaphrahgm which is circular piezo-electric disc 10, know per se, connected by leads 12 to driving circuitry (not shown). The disc 10 forms one wall of a Helmholtz resonator, the remainder of which is defined by a plastics or metal cap 14 comprising a circular end wall 16 and a peripheral skirt 20 extending from the end wall 16 and providing a recess which receives the disc 10. The end wall 16 has a central aperture 18 for the emission of sound. The sounder thus described is known per se. In the preferred embodiment, a baffle is formed by further circular disc or plate 22 is mounted above the end wall 16, i.e. on the side of the end wall remote from the disc 10 and is parallel with wall 16 and spaced therefrom by a few millimeters, for example by legs or other structure extending from the edge of the plate 22 and engaging the plastics casing 14. The space defined between the plate 22 and the end wall 16 is identified by reference numeral 24 and defines, from the point of view of sound waves emanating from the central aperture 18 and proceeding radially through the gap between the plate 22 and end wall 16, a passage of progressively increasing cross sectional area and thus provides a measure of "horn-loading" of the sounder, increasing the efficiency of the device as a converter of electrical energy into sound energy, so that for a given available electrical power, a greater volume of sound is produced. Such a device can be made relatively small and obtrusive, for example occupying less than one cubic inch and can thus readily be mounted inside the casing of a car radio or computer for example. The profile of the casing 14 and the plate 22 need not be circular but may be, for example, square or oblong.

Figure 2:
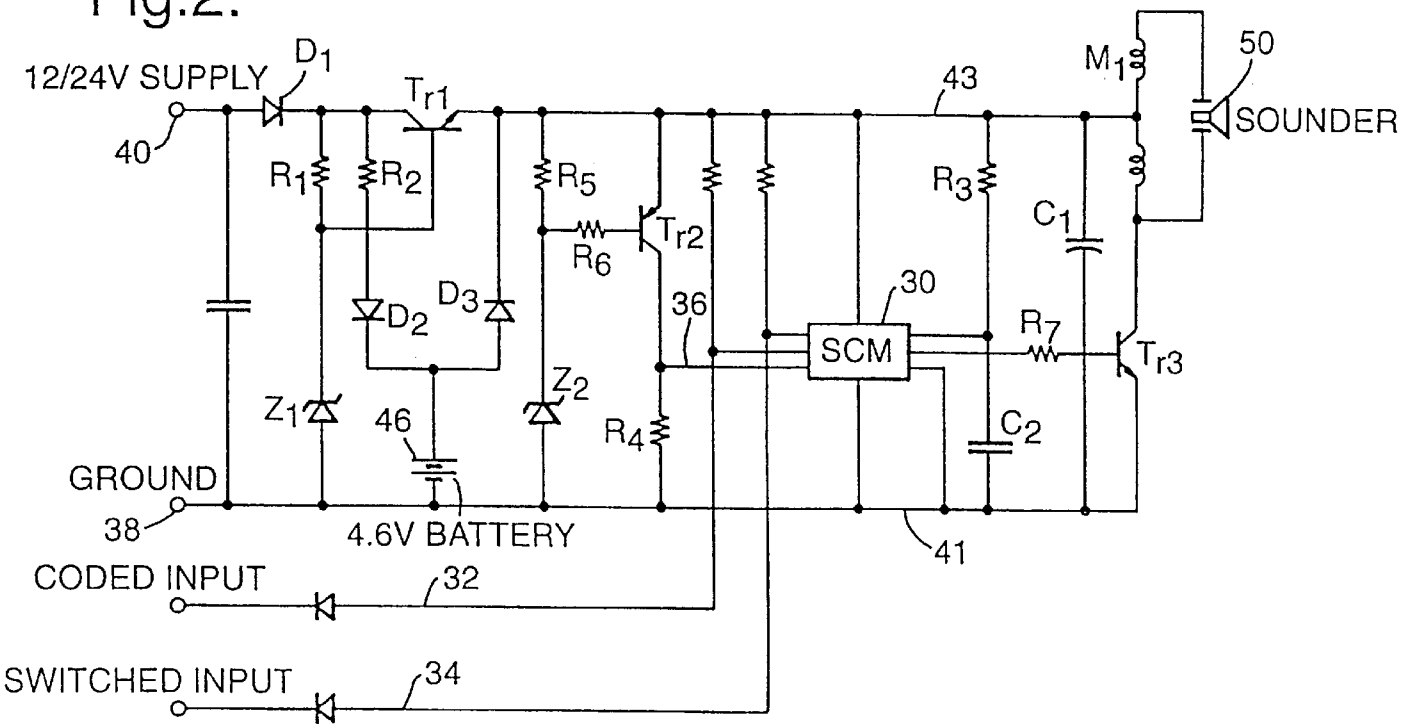
FIG. 2 is a schematic block diagram illustrating circuitry of the alarm system according to the present invention.

Referring to FIG. 2, there is illustrated part of the circuitry of an alarm device in accordance with the present invention. A single chip micro-controller (SCM) 30 provides the basis for the circuit. The device 30 may comprise, for example, a PIC16C5X (Arizona microchip), and Z86C0X (Zilog) or similar device. This receives input from the associated sensors (not shown) associated with the alarm device, including, for example, the infra-red receiver or other means by which coded input may be provided to the alarm device by the legitimate user to de-activate or re-arm the same etc. as described above. Such inputs are represented at 32 (coded input) and 34 (switched input) in the drawings. An input 36 provides the specific indication as to when the device has been disconnected from the main battery supply of the vehicle. The circuit comprises a negative supply rail 41 connected with a negative terminal 38 and comprises a positive supply terminal 40. In normal operation of the alarm device, with terminal 38 connected to battery negative (earth) and terminal 40 connected to the vehicle battery positive (live) supply terminal, the vehicle battery energises a supply regulator for the alarm device which regulator comprises a transistor TR1, the collector of which is supplied with current from terminal 40 via a diode D1, the transistor TR1 being controlled by a voltage reference circuit comprising a Zener diode Z1 and a resistor R1 connected in series between the cathode of diode D1 and the negative supply rail 41. The base of transistor TR1 is connected to this voltage reference circuit and transistor TR1 thus provides, in normal use, a regulated output voltage, significantly less than the vehicle battery voltage, on a positive supply rail 43. A chargeable battery 46, which energises the relevant part of the circuitry if the alarm device is disconnected from the vehicle electrical system, has its negative terminal connected with the negative rail 41. A limited charging current is normally provided through the battery 46 from the cathode of diode D1 by a circuit branch comprising resistor R2 and diode D2 in series. The positive terminal of battery 46 is further connected via a diode D3 with the positive supply rail 43. The voltage of battery 46 in a charged condition is significantly less than the voltage on rail 43 in the normal condition in which the terminals 38, 40, are electrically connected within the vehicle battery. Accordingly, diode D3 is normally blocked. An electrolytic capacitor C1 provides a low impedance path to a.c. between lines 43 and 41. An R.C. timing circuit comprising resistor R3 and capacitor C2 connected in series between rail 43 and 41 is connected with one terminal of the device 30 and is used by the latter for timing purposes.

Device 30 is connected by power supply lines between supply rails 43 and 41. The voltage at input 36 is determined by a circuit comprising transistor TR2, having a collector load resistor R4 connected with negative rail 41, the positive side of resistor R4 being connected to input 36. A biassing circuit for transistor TR2 comprises a Zener diode Z2 and resistor R5 connected in series between the rail 41 and 43, the base of transistor TR1 being connected with the junction between Z2 and R5 via a resistor R6. The characteristic voltage of Zener diode Z2 is so selected in relation to the normal voltage on line 43 and the voltage of battery 46 that, upon disconnection of terminal 40 from the vehicle battery positive supply, transistor TR2, normally held on by the R5/Z2 biassing circuit, rapidly turns off, thereby signalling to device 30 the disconnection of the device from the vehicle battery. The device 30 drives the piezo-electric sounder or buzzer of FIG. 1 (indicated at 50 in FIG. 2) through an auto-transformer arrangement M1, preferably in the form of a toroidal auto-transformer, driven by transistor TR3 controlled, via resistor 37, from an output of device 30. The preferred form of the alarm unit, such as that installed within a car radio casing or within a computer casing may be made to produce 107 decibels of sound for 30 mw of power.

Reference has been made above to the use of an embodiment of the invention to provide protection against theft of computer "chips". A further or alternative means of providing protection from theft of valuable components such as integrated circuit "chips" in a computer, or at least of making such theft unrewarding, is described below.

In this variant, the individual chips are provided with sound emitting means, (for example, incorporating a piezo-electric sounder along the lines described above), and with additional circuitry including driving circuitry and alarm circuitry associated with the sounders. Said additional circuitry may be incorporated in the integrated circuit which contains the respective computer circuitry, or may be incorporated in an additional integrated circuit incorporated in the same plastics or ceramic package as the integrated circuit "chip" containing the computer circuitry.

In this variant, an individual chip may incorporate a compact battery, for example a rechargeable battery arranged to be kept in a state of charge by the power supply of the associated computer during use of the latter, for powering the alarm and sounder-driving circuitry. The arrangement may be such that when the chip is removed illegitimately from its computer, it will, either immediately, or after a pre-set delay, emit an alarm signal. The additional circuitry may also, for example, include an infra-red or ultrasonic receptor arranged to receive a coded ultrasonic or infra-red signal from a transmitting device, whereby the alarm may be deactivated by operation of the transmitting device, when it is desired, legitimately, to remove the chip and/or whereby the alarm may be activated ore reactivated, for example when the chip is replaced or after a new chip is first installed. In this context it is envisaged that chip transmitter sets will be manufactured each with a unique code (or at least a code common to a relatively small percentage of the chip transmitter sets manufactured) and that each chip will be supplied together with the appropriately coded transmitter. Alternatively, the chips and transmitters may incorporate, or may be supplied with, means allowing the purchaser to record permanently in each chip and in the transmitting device, a code number selected by the purchaser, whereby chips, identical with one another, may be mass-produced and transmitting devices, likewise identical with one another, may be likewise mass-produced without the requirement for "unique coding" increasing manufacturing costs. Furthermore, the latter arrangement would allow all of the chips in a computer to be responsive to the same code, so that the alarms of all chips in the computer could be activated and de-activated using the same transmitter.

In a further variant, instead of a separate transmitting device, the chips may be arranged to receive the respective code via the computer's keyboard input, for example.

Preferably, the arrangement is such that a protected chip, if stolen, is rendered inoperative by said additional circuitry, either permanently, or until and unless it receives the appropriate coded signal, whereby stolen chips will be rendered unsaleable, thus making theft of the chips unattractive. Furthermore, in addition to being rendered inoperable by the additional circuitry referred to, a stolen chip may be arranged, when reinstalled in a computer without having received the appropriate coded signal, to commence or recommence emitting an alarm signal and/or may be arranged, when the computer is powered up, to cause an appropriate message to be displayed on the VDU associated with the computer, indicating that the chip has been stolen.

In a further variant, in which the alarm system, (or, indeed, an additional alarm system in accordance with the invention) is fitted to a theft-prone component of a computer, the alarm system may be arranged additionally, if the component is successfully stolen and eventually fitted in another computer, to pass signals within that other computer such as to corrupt the operating system or other software of that computer and thereby render that other computer unworkable, and/or may additionally cause that other computer to display a message indicating that a stolen component has been installed.

It will be understood that similar provisions to those disclosed above in relation to computers may be adopted, where appropriate, for other items of a utilitarian nature, so that such items, likewise may be rendered inoperative, and therefore unsaleable, by theft.

As an alternative, or an addition to the above-noted provisions for preventing or discouraging theft of computers or of components from computers, and which is particularly applicable to computers which are connected via modems or the like with telephone or other communication lines, or which are networked with other computers, the alarm system incorporated in or associated with such a computer may be arranged, upon detecting that a theft is in progress, to send a message by such telephone or other communication line to a remotely located alarm or like facility, for example to communicate with a police station to notify the police that the theft is in progress and/or to notify relevant personnel or management, or to transmit a message to the other computers networked with the computer which is the subject of the theft to cause these other computers to generate an appropriate alarm or advisory message, so that, for example, a person working at a computer in one part of a building will be advised that a theft of, or from, a computer located in another part of the building is taking place. Conveniently, the alarm system may be arranged to leave an appropriate E-mail message with an appropriate subscriber, for example with an insurer or a corporate headquarters.

A burglar alarm serving the relevant premises generally may likewise be arranged to be activated, inter alia, by such an alarm signal transmitted directly or indirectly from the computer which is the subject of the theft or attempted theft on the respective telephone or other communication line, whether such burglar alarm is located locally, e.g. within the hearing of the presumed thief, or remotely, for example at the offices of security personnel.

The invention also has utility in relation to other valuable items of a functional nature, particularly such items which incorporate electronic circuitry. Thus, such items as portable telephones, for example, may incorporate alarm circuitry which, when activated will transmit an alarm signal to a selected subscriber or subscribers, for example a police or other security monitoring service, to alert such subscriber to the fact that the portable telephone has been stolen. The alarm circuitry of the telephone may, if desired, also transmit locally an audible alarm signal.

The use of a separate, and conveniently compact, portable and unobtrusive coded ultrasonic or infra-red transmitter, may, in this case, provide a means for detection of theft so that, for example, the arrangement may be such that the legitimate user must, before making a call, de-activate the alarm system using the respective coded transmitter, whilst an attempt to make a call without doing so or using the wrong transmitter will result in a theft alarm call being transmitted. In an alternative arrangement, if may simply be necessary for the user to input a respective unique code via the normal "dialling" mechanism before making a call in order to de-activate the alarm signal for the duration of that call. The system may also, or alternatively, be arranged to sound or transmit an alarm signal if the normal batteries of the portable telephone run down or are removed whilst the alarm is activated. (The alarm circuitry may again be powered by a separate compact battery arranged to be charged with or from the main battery and concealed from the user).

In appropriate embodiments of the invention, the alarm may alternatively or additionally be triggered by movement of the protected device itself, for example as sensed by a trembler switch or by a tilt switch (e.g. mercury switch) incorporated in the item or a mechanical switch arranged to be operated by removal or lifting of the protected item from its normal location, e.g. lifting of a computer case or removal of a car radio from its installation slot.

Where electrically powered items, such as television sets, video recorders, sound reproduction equipment and so on are protected by an alarm system in accordance with the invention the alarm may be arranged (or additionally arranged) to sound and/or generate other alarm signal when the item is again connected to an electricity supply. Where alarm systems in accordance with the invention are used to protect electrically powered items which are normally remotely controllably by remote control units in manner known per se, for example television receivers or video recorders incorporating infra-red receivers for receiving infra-red control signals from hand-held remote control units by means of which the tuning of such receivers between different broadcast channels can be changed, or recording instructions entered, or operating mode changed, and so on, it is convenient to use such otherwise conventional remote control facilities also to control the enabling and disabling of the alarm. The system may, (cf. the discussion above in relation to car radios) incorporate means for disabling the alarm to allow the legitimate owner to unplug the item concerned from the mains supply and/or to move the item, and to enable to alarm again after it has been disabled. In such cases the arrangement may be such that a predetermined code known only to the owner may be entered on the remote control device and transmitted to the protected item.

The system may incorporate means allowing such a code, in the form, for example, of an identification number of the user's own selection to be entered and stored in the system, so that the possibility of a third party learning the number concerned is minimised. The system may alternatively or additionally incorporate an identification code, likewise required for disabling the alarm, to be entered by the manufacturer and supplied to the legitimate user, thus providing, (where this facility is provided additionally), an extra level of security.

Furthermore, the alarm system may, in all appropriate embodiments of the invention, include a facility for switching between different enabled alarm modes. For example, where the item protected by the alarm system is a device which in use is connected with the electrical mains, the alarm system may be switchable between a first mode in which the alarm will be set off by disconnection from the mains and a second mode in which the alarm will not be set off by such disconnection but will, or will still, be set off by moving or tilting the protected device. Thus the user may normally keep the alarm system in said first mode, but may switch it to the second mode when, for example, the premises in which the device is kept are to be left unattended for an extended period and there is the possibility that the alarm might be triggered by, for example, a power cut if left in its first mode and might consequently cause a nuisance without justification. Where the device is an item such as a television receiver or video recorder normally controlled by a remote control device, the switching of the alarm system from said first to said second mode and vice versa may, of course, also be effected by way of such remote control device.

In any of the above embodiments in which the alarm is incorporated in the item protected by the alarm, and in which, therefore, the energising circuitry and battery for the alarm are also incorporated in the protected item, various measures may be adopted to afford the maximum of useful effect from the necessarily limited amount of electrical energy stored in the battery. Thus, the ideal is to have a noisy alarm which will sound for a long time and which yet does not use much battery power, for practical battery size is limited. Some approach to this ideal can be achieved by arranging for the alarm to sound intermittently rather than continuously. It has also been found that intermittent noise is more effective than continuous noise attracting attention in many situations. A good example is a car alarm. Everyone notices it when it first goes off but disregards it when the alarm continues. Accordingly it is preferred that the alarm systems in accordance with the invention be capable of producing an intense noise, for example at 110 dB(A) or more, but that the alarm is sounded only spasmodically in order to extend battery life. Preferably the alarm is sounded spasmodically but not in any set pattern. Thus, for example, the alarm may be arranged to sound at random intervals, or may follow, for example, a pseudo-random pattern of longer and shorter bursts of sound, arranged to occur at different time intervals. The unpredictability of the time of occurrence of the next burst of sound is calculated to startle the thief and induce anxiety which may lead him to abandon the stolen item.

The alarm circuitry may be so arranged that these intervals, and thus the percentage of total time for which the alarm is silent, become longer as the battery becomes progressively discharged, and indeed a capacitative charge/discharge arrangement may be provided allowing even an almost fully discharged battery to provide enough energy for a final loud sounding of the alarm.

By making the sounding of the alarm intermittent it will have a more disconcerting effect on the thief, and will render the thief more noticeable to passers-by. Furthermore because the alarm is sounded only intermittently, it is possible, for a given battery capacity, to use a louder alarm (using more power when activated) than would be practicable if the alarm were to sound continuously.

In further embodiments of the invention, the alarm may be adapted to prevent of deter theft of automobiles themselves rather than merely the theft of radios or other items from automobiles.

In such further embodiments, appropriate sensors, known per se, are arranged to respond to unauthorised entry to the vehicle or an unauthorised attempt to start the engine, the alarm being arranged, in addition to providing an alarm signal, to immobilise the vehicle by, for example, disabling the ignition system, fuel supply etc. The alarm signal may include an audible alarm sounded in the vehicle itself and/or may include a radio or infra-red signal transmitted to a remote receiver or to nearby ones of a network of such receivers whereby the stolen vehicle can be tracked to assist recovery and apprehension of the thief if the thief should somehow manage to circumvent the immobilisation of the vehicle by the alarm system.

In one arrangement, the alarm system may be arranged to determine the position of the vehicle by reference to navigation satellites and to include, in the signal transmitted, information as to the current position of the vehicle, thereby to assist its location and recovery. The alarm system may, for example, be arranged to transmit an alarm signal and positional information by way of the cellular telephone system now established in most advanced countries. Alternatively, or additionally, the alarm system may be arranged to transmit radio or the like signals directly to appropriately equipped satellites arranged to respond by, for example, tracking the vehicle, alerting police authorities in the appropriate area, etc.

It will be appreciated that an alarm arrangement utilising the satellite navigation system may most conveniently be provided in a vehicle which additionally incorporates a facility for determining the vehicle's position, for navigational purposes, by reference to such navigation satellites. Conveniently, in this case, an input facility, such as a keyboard, provided for operation of the navigation facility, may also serve as a means whereby the legitimate user can enter an appropriate identification code or number to de-activate the alarm system.

Preferably the vehicle alarm system is arranged, when the alarm is set off, also to disable, e.g. until re-set by an appropriate coded input, components such as the car radio, cassette player or the like which would otherwise be attractive to the thief.

Whilst the alarm system may be capable of being de-activated by the legitimate user of the alarm-protected article, (whether a motor vehicle or some other article) by means of a mechanical key-operated lock, or a magnetic card reader operated by a magnetic card carried by the user, or by a keyboard via which the user may enter an identifying code, it is preferred to utilise an activating and de-activating arrangement using a remote-controlled device carried by the legitimate user and which, when operated, transmits to an appropriate receiver in or on the vehicle or other article, via a radio or infra-red signal, an identifying code. Preferably the arrangement is such that by operation of an appropriate communication protocol between the remote control device and the corresponding unit in the car or other article, the identifying code is changed each time the remote control device is used to de-activate the alarm system.

In a further variant of the invention, as applied to car radios (as herein defined) and the like, and motor cars or other vehicles themselves, the motor car or other vehicle in which the radio is installed may have an alarm system associated therewith and arranged to operate when the vehicle is interfered with in any way, whether or not the interference concerned involves an attempt to remove the radio, and the last-noted alarm system may be coupled to the alarm system incorporated in the radio, so that the alarm in the radio will also be triggered when the vehicle alarm system detects interference with the vehicle. Conversely, the vehicle alarm system may be arranged, (if for some reason it is not triggered by entry of an unauthorised person into the vehicle in the first place), to be triggered when the alarm incorporated in the car radio is triggered. The vehicle alarm system may be arranged, when triggered, not only to sound an audible alarm, but also to immobilise the vehicle. In this case, the arrangement is preferably such that the legitimate user of the vehicle may nevertheless subsequently cancel the immobilisation of the vehicle, for example by means of a physical key or by keying an appropriate code on a keyboard or, preferably, by operation of a remote control device normally used to activate and de-activate the alarm, and which may operate by transmitting, via a radio signal or infra-red beam, a code which will be recognised by receiving means on board the vehicle. If desired, the appropriate code may be arranged to be changed automatically, in known manner, each time the alarm is set.

In accordance with a further aspect of the invention, and which may also be utilised with advantage even where no car radio or the like is provided having an alarm system, the vehicle alarm system, or the vehicle immobilising system, may incorporate one or more control circuits which, or each of which, is small enough to be housed in one of the relatively large numbers of plug and socket connectors which feature in the electrical wiring of a typical modern motor vehicle, said control circuit normally providing a path for current flow in a conductor extending to the connector (being, for example, a conductor the flow or current through which is essential to the running of the vehicle) but being capable of being placed in a condition in which it forms a break in such path, by a coded electrical signal, for example a coded pulse sequence, supplied to it via that conductor or another conductor extending to the same connector, such coded signal being transmitted from alarm circuitry in the vehicle when the vehicle alarm is triggered. Alternatively, or additionally, the circuit housed in such connector may be arranged to establish an electrical connection, for example to an audible or visual alarm device, on receipt of a coded signal, where in normal use the connector provides an open circuit. The control circuit may conveniently take the form of, or include, a logic "chip", that is to say an integrated logic circuit.

Either arrangement, utilising a miniature control circuit fitted with a "standard" connector, has the advantage that even if a determined thief should open the vehicle bonnet in an attempt to locate the vehicle-immobilising, or alarm-generating device with a view to neutralising such device, the location of such control circuit will be far from obvious and even if the thief is aware that the device in question may be located within one of the connectors, the thief will face the task of checking each connector in turn before the control circuit is located, a time consuming and therefore unattractive and risky procedure.

Such an arrangement, whereby such a control circuit is housed within a "standard" connector, or even merely within a connector having the outward appearance of a standard connector, represents a particularly convenient way of fitting an alarm and/or immobilising system to existing vehicles. Thus, for example, an alarm "kit" for fitting to a vehicle may include a "standard" connector or selection of "standard" connectors having sockets to receive which, at the purchaser's choice may be substituted for one of the existing connectors in the vehicle and correspondingly connected in the respective part of the electrical circuitry of the vehicle.

A similar expedient may be used in retro-fitting alarms to, for example, expensive electrically-powered domestic consumer items such as television receivers, video recorders, or computers. That is to say alarm circuitry, or part of such alarm circuitry may be incorporated within the standard connectors or connectors having the appearance of standard connectors, such as electrical wall-plugs.

What is claimed is:

1. An alarm system for detecting attempted theft of an article, said alarm system including means incorporated in the article itself and arranged to transmit and to continue transmitting an alarm signal when the article is removed from an original location thereof, or disturbed, said alarm system including a generator so arranged that, when triggered, said generator generates an audible alarm signal at random or pseudo-random intervals or produces a random or pseudo-random pattern of longer and shorter bursts of alarm signal arranged to occur at different time intervals, said generator including a sounder device having a chamber including a cap receiving a piezo-electric disc of a diaphragm forming at least part of a chamber wall of said chamber, said cap having a wall provided with an aperture arranged for the passage of sound waves between a baffle outside said chamber and opposing said aperture, said baffle including a plate spaced by a structure extending between said plate and said cap wall by a small gap defining with said cap wall a peripherally open space radially from the region of said aperture, and a battery for powering said generator, the alarm system being such that said intervals become longer as said battery becomes progressively discharged.

2. The alarm system according to claim 1 wherein said plate is circular and mounted on a side of said end wall remote from said piezo-electric disc.

3. The alarm system according to claim 1 wherein said small gap forms a passageway for sound waves of progressively increasing cross-sectional area for increasing the efficiency of conversion of electrical energy into sound energy.

4. An alarm system for detecting attempted theft of an article, said alarm system including an alarm in such an article triggered in attempted theft of the article; and alarm signal generator responsive to said alarm for generating an audible alarm signal at random or pseudo-random intervals or producing a random or pseudo-random pattern of longer and shorter bursts of alarm signal arranged to occur at different time intervals, said alarm signal generator includes a sounder device having a chamber including a cap receiving a piezo-electric disc of a diaphragm, said diaphragm forming at least part of a chamber wall of said chamber, said cap having a cap wall provided with an aperture arranged for the passage of sound waves between a baffle outside said chamber and opposing said aperture, said baffle including a plate spaced by a structure extending between said plate and said cap wall by a small gap defining with said cap wall a peripherally open space radially from the region of said aperture, and a battery for powering said alarm signal generator such that said intervals become longer as said battery becomes progressively discharged.

5. The alarm system according to claim 4 wherein said plate is circular and mounted on a side of said end wall remote from said piezo-electric disc.

6. The alarm system according to claim 4 wherein said small gap forms a passageway for sound waves of progressively increasing cross-sectional area for increasing the efficiency of conversion of electrical energy into sound energy.

* * * * *